United States Patent [19]

Towsend

[11] 4,104,618

[45] Aug. 1, 1978

[54] REMOTE SIGNALING SYSTEM

[76] Inventor: Marvin Stanley Towsend, 1365 Potomac Hts. Dr., Oxon Hill, Md. 20022

[21] Appl. No.: 802,558

[22] Filed: Jun. 1, 1977

Related U.S. Application Data

[63] Continuation-in-part of Ser. No. 732,784, Oct. 15, 1976, which is a continuation of Ser. No. 586,512, Jun. 12, 1975, abandoned.

[51] Int. Cl.[2] ..... G08B 25/00

[52] U.S. Cl. ..... 340/524; 340/166 R; 340/539; 340/324 M; 340/381

[58] Field of Search ..... 340/23, 24, 166 R, 213 R, 340/225, 324 M, 378 R, 381, 409, 412

[56] References Cited

U.S. PATENT DOCUMENTS

| | | | |
|---|---|---|---|
| 2,605,342 | 7/1952 | Spurling | 340/166 |
| 3,461,454 | 8/1969 | Streckenrider | 340/24 X |
| 3,624,626 | 11/1971 | Creadie | 340/223 |

*Primary Examiner*—Alvin H. Waring

[57] ABSTRACT

A central console monitoring system for simultaneously monitoring a plurality of remote stations distributed in a matrix array comprising: (a). a matrix array of remote stations; (b). a matrix array of two families of intersecting energy waveguides; (c). a signaling system utilizing wave energy sources, energy waveguides, energy beam splitters, energy beam couplers, energy beam combiners, and energy wave detectors; and (d). a display of linear visual display elements which intersect in a matrix pattern which indicates, in microcosm, the macrocosmic matrix array of the remote stations.

9 Claims, 2 Drawing Figures

REMOTE SIGNALING SYSTEM

CROSS REFERENCE TO RELATED APPLICATION

This application is a continuation-in-part of pending application Ser. No. 732,784 filed Oct. 15, 1976, which was a continuation of application Ser. No. 586,512 filed June 12, 1975, now abandoned.

FIELD OF THE INVENTION

The invention here presented is broadly in the remote signaling art. More specifically it is in the art of remote monitoring of a matrix array of remote stations. Monitoring for alarm conditions such as fire and burglary in apartment or office buildings is the primary field of application.

BACKGROUND OF THE INVENTION

In current remote signaling systems for monitoring a matrix array of remote stations, electrical conductors are used as signal conveyances; and electrical switches are used as signaling means in the remote stations.

For alarm systems monitoring illegal entry, electrical conductors and electrical switches present an undesirable characteristic in that they may be surreptitiously shunted or by-passed without the alarm's being triggered. For this reason it would be desirable to have an alarm system which did not employ electrical conductors and switches as signal conveyances and signaling means, respectively. Furthermore, for structures such as apartment or office buildings, it is desirable to use a matrix array of signal conveyances because of the economy of materials and relative ease of installation inherent in matrix systems.

In view of the foregoing, it is an objective of the invention to provide a new remote signaling system which employs a matrix array of energy waveguides serving as signal conveyances and sensor-controlled energy beam couplers serving as signaling means in the remote stations.

Another objective of the invention is to provide a display of linear visual display elements which intersect in a matrix pattern which is a microcosm of the macrocosmic matrix array of the remote stations.

SUMMARY OF THE INVENTION

These and other objectives are accomplished by the invention as described below. Energy waveguides are distributed in a matrix array of row and column energy waveguides and are used as signal conveyances. Within each remote station distributed in the matrix array, means responsive to the monitored conditions, such as burglary or fire, are used to signal the central console by coupling to or decoupling from the wave energy which normally passes through the remote station along its associated row and column energy waveguides. Each row and column energy waveguide has an associated energy wave source and energy wave detector. At the central console, each row and column energy waveguide has an associated row and column linear visual display element. The row and column visual display elements intersect in a matrix pattern which is a microcosm of the macrocosmic matrix array of the remote stations.

The novel features characteristic of the invention as to its organization, method of operation, and applications will best be understood by the description presented below when read in connection with the accompanying drawing. Although the description presented below relates especially to the embodiments of the invention illustrated in the drawing, this description is not intended to limit the scope of the invention which is defined in the claims.

DETAILED DESCRIPTION OF THE INVENTION

Figure 1:
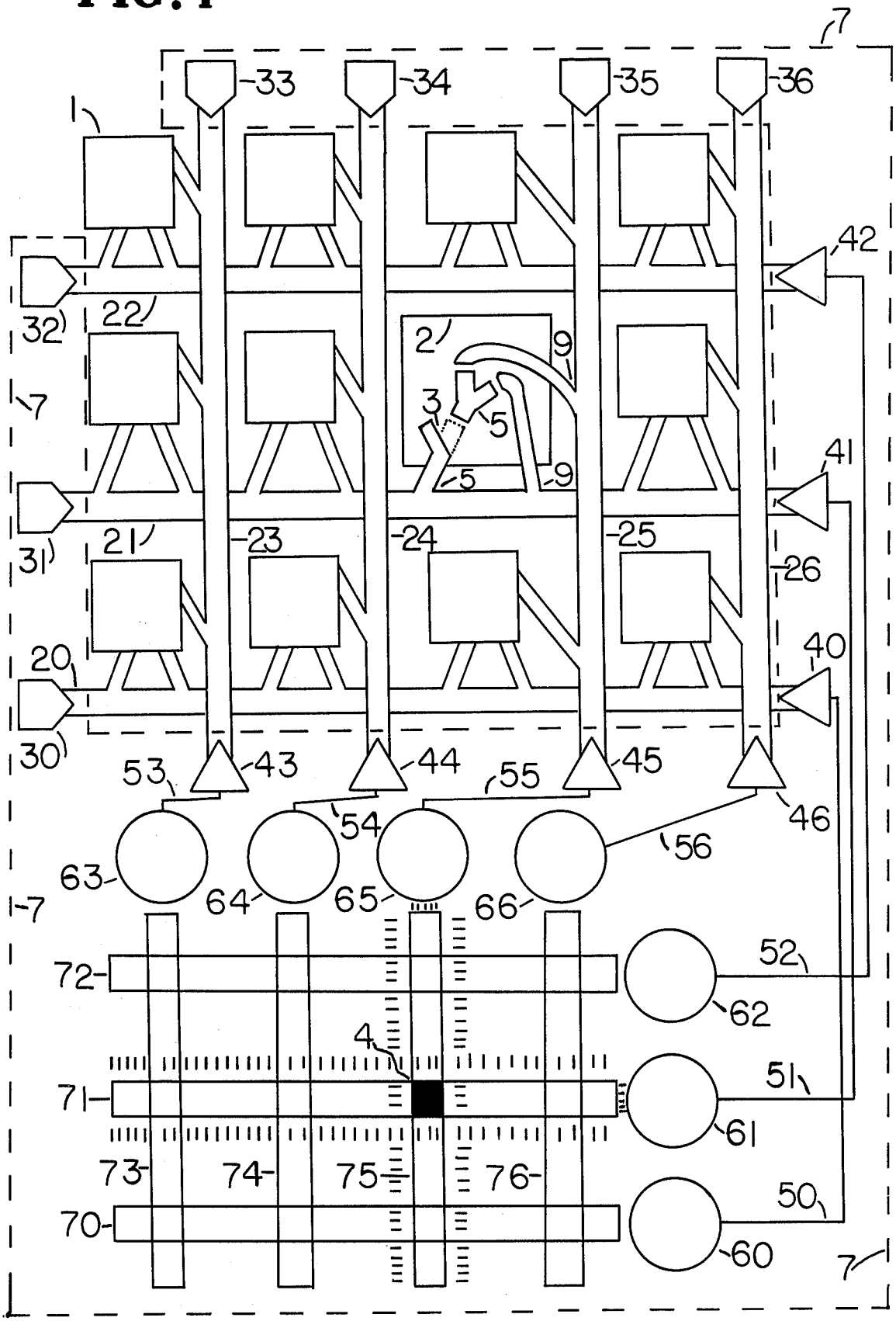
FIG. 1 shows an embodiment of the invention employing one normally coupling energy beam coupler in each remote station.

Referring to FIG. 1, associated with a matrix array of remote stations 1, there are row energy waveguides 20–22 and column energy waveguides 23–26. The group of remote stations which are connected to a particular row energy waveguide comprise the stations in the row zone associated with that waveguide. Similarly, the group of remote stations connected to a particular column energy waveguide comprise the stations in the column zone associated with that waveguide.

Each energy waveguide 20–26 has one of each of the following groups of elements associated with it: energy wave sources 30–36; energy wave detectors 40–46; electrical conductors 50–56; zonal indicators 60–66; and linear visual display elements 70–76. In the Drawing, the energy wave detectors are wave energy-to-voltage transducers which are connected to the zonal indicators by electrical conductors.

Within each remote station 1, one or more energy beam couplers 3 are connected to the row and column energy waveguides associated with the remote station by means of energy beam splitters 5 and energy beam combiners 9.

To illustrate the operation of the invention, a representative remote station 2 is taken as an example. Energy wave sources 31 and 35 are connected to energy waveguides 21 and 25 which are connected to remote station 2. A signal generated in remote station 2, such as by decoupling of normally coupling energy beam coupler 3, would be conveyed by its associated energy beam splitters 5 and energy beam combiners 9 to its associated row and column energy waveguides 21 and 25; to its associated energy wave detectors 41 and 45; through its associated electrical 51 and 55; to its associated zonal indicators 61 and 65; and to its associated linear visual display elements 71 and 75.

Linear display elements 71 and 75 intersect at point 4. In general, the visual display elements 70–76 are arrayed in a two dimensional matrix whereby the points of intersection of the linear display elements correspond in microcosm to the macrocosmic two dimensional matrix array of the remote stations. Intersection point 4 corresponds with remote station 2. Both are positioned in the second row and third column of their respective matrices.

A central console 7 is comprised of the microcosmic display, zonal indicators, energy wave detectors, and energy wave sources.

Figure 2:
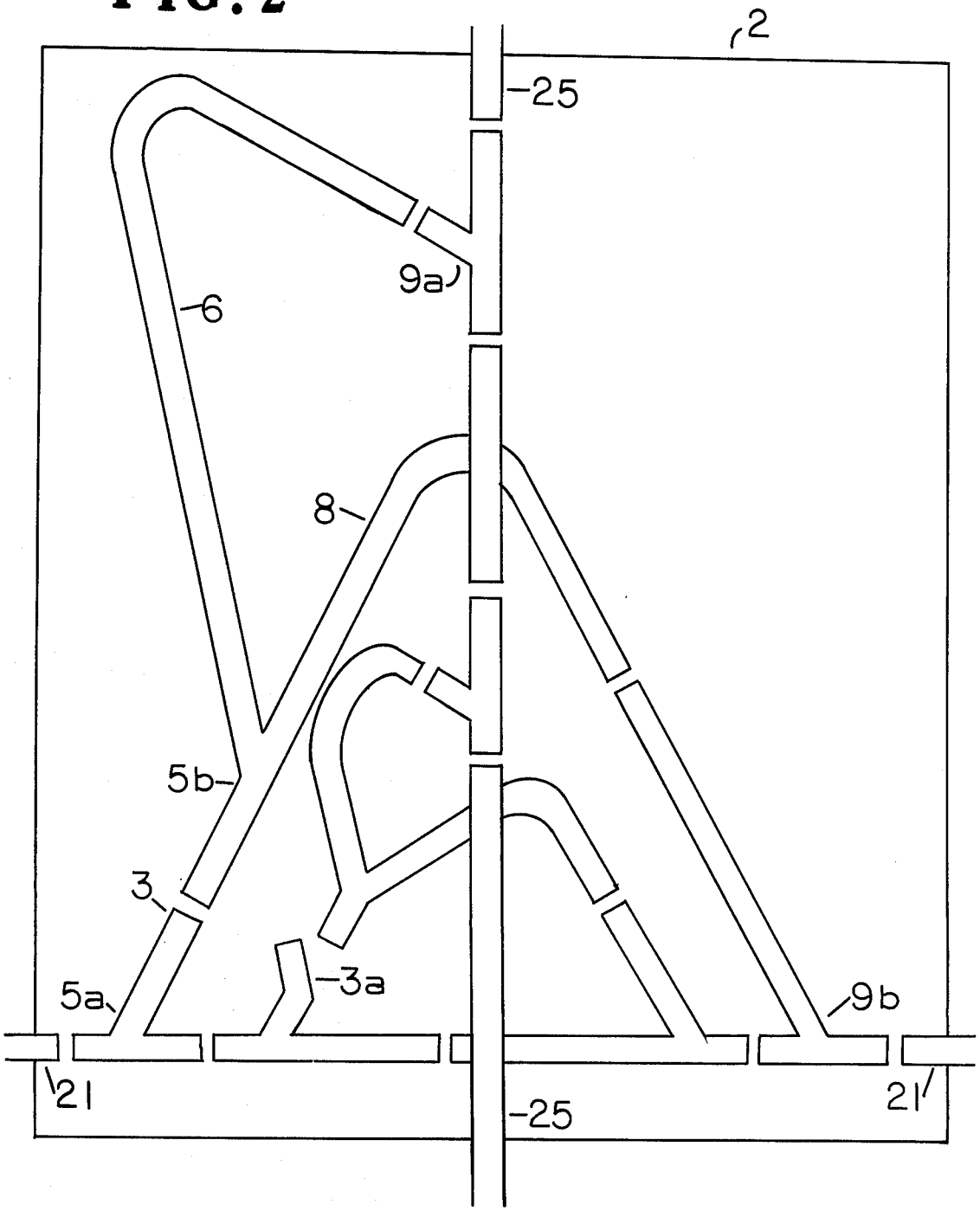
FIG. 2 shows a remote station having one normally coupling energy beam coupler and one normally decoupling energy beam coupler.

In FIG. 2, a close-up of remote station 2 in FIG. 1 is shown. A normally decoupling energy beam coupler **3*a* and a normally coupling energy beam coupler 3** are shown in the same remote station 2. The row energy wave guide 21 enters the remote station 2 on the left, exits on the right, and subsequently conveys wave energy to its detector. Before reaching the detector, a portion of the wave energy is directed by energy beam splitter 5*a* to the normally coupling energy beam coupler 3. The wave energy which passes through energy beam coupler 3 is further split by energy beam splitter 5*b* into two portions. One portion enters short waveguide 6 and then energy beam combiner 9*a* and augments the energy in column energy waveguide 25 which enters remote station 2 from above and exits from below. The other portion enters short waveguide 8 and then energy beam combiner 9*b* and augments the energy in row energy waveguide 21.

During normal, non-alarm or supervisory conditions, energy wave detectors 41 and 45, which are wave energy-to-voltage transducers in the embodiment in FIG. 1, are balanced for normal supervisory conditions. When an event causes signaling, which results from the decoupling of normally coupling energy beam coupler 3 in remote station 2, both detectors 41 and 45 receive less than the normal wave energy and become unbalanced, thereby lighting zonal indicators 61 and 65 which in turn light linear visual display elements 71 and 75 which intersect at point 4.

In contrast, when an event results in the coupling of normally decoupled energy beam coupler 3*a*, the amount of wave energy reaching detectors 41 and 45 is greater than normal. Thereby the energy wave detectors 41 and 45 become unbalanced, and point 4 is illuminated.

Thus the detectors can differentiate between two types of alarm conditions. On the one hand, when a normally coupled energy beam coupler such as 3 becomes uncoupled, the detectors both receive less than normal wave energy; and they are moved out of balance. On the other hand, when a normally uncoupled energy beam coupler such 3*a* becomes coupled, the detectors both receive greater than normal wave energy; and they are moved out of balance.

Referring to FIG. 1 and remote station 2, an alternative employment of the concepts of the invention allows elimination of energy beam coupler 3 and elimination of the energy beam splitters 5 which are connected to energy waveguide 21. In place of these eliminated elements, substitution with a wave energy source (similar to wave energy sources 30–36) near the open ends of energy beam combiners 9 can be made in remote station 2. The amount of wave energy detected by wave energy detectors 41 and 45 depends upon the energy supplied by the wave energy source in remote station 2 as well as the wave energy sources 30–36.

In like manner, wave energy sources may be supplied to each remote station 1, thereby eliminating the need for wave energy sources 30–36 at the source end of the energy waveguides. By employing wave energy sources in each of the remote stations 1, the structure of central console 7 is simplified. There is no longer a need for wave energy sources 30–36 at the central console. The operation of the energy wave detectors 40–46 remains the same, however. When the normal amount of wave energy generated by a remote station 1 is decreased, both its associated row and column wave energy detectors are moved out of balance by receiving less than the normal amount of wave energy. When the normal amount of wave energy generated by a remote station 1 is increased, both its associated wave energy detectors are moved out of balance by receiving more than the normal amount of wave energy.

In implementing this invention a variety of alternatives are possible. Systems employing the concepts of the invention may have normally coupled energy beam couplers alone, or normally decoupled energy beam couplers alone, or a combination of both types. The type of coupling may be either simply coupled or decoupled, or it may be cyclical. The alarm sensors may effect signaling by mechanical energy beam couplers, or they may signal the central console by causing electrical-to-wave energy changes in the energy waveguides. One wave energy source may be used with plural energy beam splitters for supplying wave energy to all the row and column energy waveguides.

The types of wave energy that may be employed in the invention are varied. Electromagnetic wave energy of a variety of wavelengths may be employed. For any chosen electromagnetic wavelength, the electromagnetic wave energy sources, the electromagnetic energy waveguides, and the electromagnetic energy detectors must be compatible. For example, in the range of visible light, optical energy sources, optical waveguides, and photoelectric transducers would be compatible.

Acoustic energy may also be employed. This would require acoustic energy sources, acoustic waveguides, and sound-to-voltage transducers.

What is claimed is:

1. A remote signaling system for simultaneously monitoring signals, at a central console display, which are generated from a plurality of remote stations distributed in a matrix array, comprising:

a. a plurality of remote stations distributed in a matrix array whereby said plurality of remote stations are distributed in a series of horizontally oriented row zones, and in a series of vertically oriented column zones;

b. two families of energy waveguides, a first family having row energy waveguides equal in number to the number of said row zones of remote stations and a second family having column energy waveguides equal in number to the number of said column zones of remote stations;

c. sources of wave energy for coupling to said row and column energy waveguides and a detector of wave energy coupled to each of said row and column energy waveguides at the detector end of each waveguide;

d. at each remote station, energy beam combiners connected with said row and column energy waveguides and a sensor-controlled wave energy source coupled to said energy beam combiners for signaling the central console by decreasing or increasing the wave energy which normally passes through the remote station along its associated row and column energy waveguides; and e. at the central console, a display of zonal indicators associated with said row and column wave energy detectors for displaying the location of the remote station in which sensor-controlled wave energy signals are generated.

2. A remote signaling system as described in claim 1 wherein:

a. said sources of wave energy for coupling to said row and column energy waveguides are equal in number to the number of energy waveguides and are connected at the source end of each waveguide; and b. said energy beam combiners connected with said row and column energy waveguides are further connected with energy beam splitters and a sensor-controlled energy beam coupler, which is effectively a wave energy source, for signaling the central console by decreasing or increasing the wave energy which normally passes through the remote station along its associated row and column energy waveguides.

3. A remote signaling system as described in claim 1 wherein:

a. said sources of wave energy for coupling to said row and column energy waveguides are equal in number to the number of remote stations; and b. each of said sources of wave energy in each remote station is connected to its associated row and column energy waveguide by means of said energy beam combiners.

4. A remote signaling system as described in claim 1 wherein said display of zonal indicators is comprised of two families of linear visual display elements arranged in groups of horizontal and vertical lines which intersect one another in a matrix array of points of intersection, having said linear visual display elements in one-to-one correspondence to their respective row zones and column zones of the remote stations and having said points of intersection of said linear visual display elements in one-to-one correspondence with the remote stations in said matrix array of remote stations; whereby said points of intersection form a matrix display in microcosm of the macrocosm matrix array of the remote stations.

5. A remote signaling system as described in claim 1 wherein:

said sources of wave energy are electromagnetic energy sources;

said energy waveguides are electromagnetic energy waveguides; and said wave energy detectors are electromagnetic energy-to-voltage transducers.

6. A remote signaling system as described in claim 1 wherein:

said sources of wave energy are acoustic energy sources;

said energy waveguides are acoustic energy waveguides; and said wave energy detectors are acoustic energy-to-voltage transducers.

7. A remote signaling system as described in claim 2 wherein one of said sensor-controlled energy beam couplers is normally in the coupling mode and is decoupled when signaling is effected.

8. A remote signaling system as described in claim 2 wherein one of said sensor-controlled energy beam couplers is normally in the decoupling mode and is coupled when signaling is effected.

9. A remote signaling system as described in claim 2 wherein one of said sensor-controlled energy beam couplers is normally in the coupling mode; and wherein one of said sensor-controlled energy beam couplers is normally in the decoupling mode.

* * * * *